US005302220A

United States Patent [19]

Terakawa et al.

[11] Patent Number: 5,302,220

[45] Date of Patent: Apr. 12, 1994

[54] METHOD FOR MANUFACTURING BULKY NONWOVEN FABRICS

[75] Inventors: Taiju Terakawa, Shiga; Shingo Horiuchi, Moriyama; Sadaaki Nakajima, Shiga, all of Japan

[73] Assignee: Chisso Corporation, Osaka, Japan

[21] Appl. No.: 757,956

[22] Filed: Sep. 12, 1991

Related U.S. Application Data

[63] Continuation-in-part of Ser. No. 494,317, Mar. 16, 1990, abandoned.

[30] Foreign Application Priority Data

Apr. 6, 1989 [JP] Japan ..... 1-87559

[51] Int. Cl.[5] ..... D04H 3/05; D04H 3/16

[52] U.S. Cl. ..... 156/167; 19/299; 156/62.4; 156/181; 264/168

[58] Field of Search ..... 156/167, 62.4, 181, 156/296; 19/296, 299, 304; 425/83.1; 264/115, 168

[56] References Cited

U.S. PATENT DOCUMENTS

| | | | |
|---|---|---|---|
| 3,459,627 | 8/1969 | Vosburgh | 156/181 |
| 3,878,014 | 4/1975 | Melead | 156/167 |
| 4,392,903 | 7/1983 | Endo | 156/167 |
| 4,551,378 | 11/1985 | Carey | 156/62.4 |
| 4,992,327 | 2/1991 | Donovan | 428/296 |
| 5,102,724 | 4/1992 | Okawahara | 28/155 |

*Primary Examiner*—Michael W. Ball
*Assistant Examiner*—Daniel J. Stemmer
*Attorney, Agent, or Firm*—Oblon, Spivak, McClelland, Maier & Neustadt

[57] ABSTRACT

A fiber bundle comprising a plurality of composite fibers spun out of a spinneret is blown against a working net conveyor by a drawing force of a high-speed air stream while the air stream is sucked and removed from below the net conveyor to deposit the fiber bundle on the net conveyor to form a web, and the web is then heat-treated to develop crimps and the fibers thermally adhere together at their points of contact, thereby obtaining a nonwoven fabric, wherein the air stream is blown against the web from below the net conveyor for a time before the heat-treatment, with an intensity sufficient to make the web to float in such a manner that the bottom face of the web rise above the net conveyor by 0.2 to 30 mm.

1 Claim, 1 Drawing Sheet

FIG. I
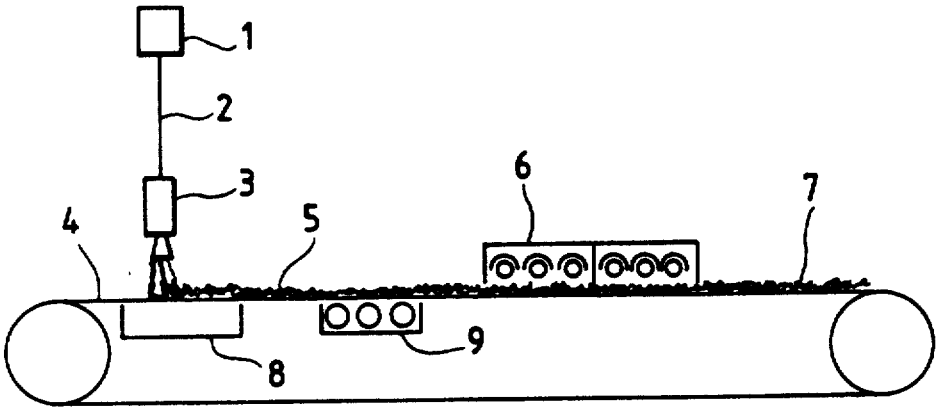
FIG. II
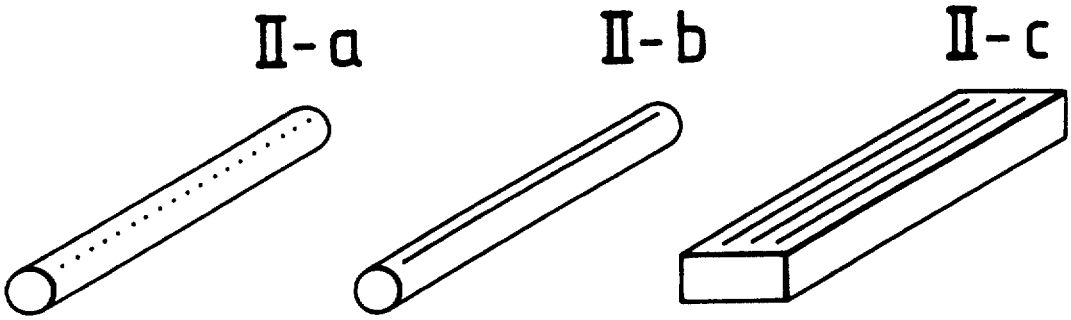

METHOD FOR MANUFACTURING BULKY NONWOVEN FABRICS

This application is a continuation-in-part of U.S. patent application Ser. No. 07/494,317, filed Mar. 16, 1990, now abandoned.

BACKGROUND OF THE INVENTION

1. Field of the Invention

The present invention relates to a method for manufacturing bulky nonwoven fabrics. More specifically, this invention is concerned with a method for manufacturing bulky nonwoven fabrics suitable for surfacings for disposable diapers, interlinings or waddings for clothing and so on.

2. Statement of the Prior Art

In recent years, there have been developed spun bonding techniques for making nonwoven fabrics by drawing and stretching a fiber bundle comprising a plurality of single fibers spun out of a spinneret with a high-speed stream of air and depositing it on a net conveyor to form a web, followed by heat treatments, some of which have been carried out on an industrial scale. According to one of the spun bonding techniques known for obtaining bulky nonwoven fabrics (Japanese Patent Application Laid-Open No. 1471/1973), for example, latently crimpable composite fibers are deposited on a net conveyor to form a web, which is then heat-treated into a crimped nonwoven fabric. According to another spun bonding technique (Japanese Patent Application Laid-Open No. 282350/1988), apparently crimping composite fibers are formed into a fiber bundle, which is then deposited on a net conveyor to form a web to be processed into an nonwoven fabric.

When a nonwoven fabric having little unevenness of weight per unit area referring as unit-weight hereafter is to be obtained by such spun bonding techniques, it is then required to prevent the once deposited web from being disturbed or blown off by a high-speed stream of air reflected off the upper face of the net conveyor. To this end, an exhaust device is provided back side of a region of the net conveyor against which the web is to be blown, thereby passing and sucking a substantially whole portion of the air stream through the net conveyor.

According to the conventional spun bonding techniques, the web is pressed against the net conveyor by the force of a high-speed air stream blown against it and the suction force of the exhaust device, as mentioned above. In consequence, the web is delivered to the next heat treatment step while it remains firmly engaged with the net conveyor. Accordingly, when a bulky nonwoven fabric is to be made with latenly crimpable fibers, any free development of crimps is inhibited even though the fibers are heat-treated so as to develop crimps, since they are firmly engaged and entangled in the net. This tends to offer such disadvantages as insufficient bulking, occurrence of unevenness of shrinkage and density on the web, and transfer of the network pattern of the net conveyor to the back side of the nonwoven fabric. Such disadvantages are liable to occur particularly in manufacturing bulky nonwoven fabrics of low unit-weight, which are used as the surfacings for disposable diapers, etc., and moreover have an influence upon commercial value. It is thus strongly desired to eliminate such disadvantages.

SUMMARY OF THE INVENTION

As a result of intensive studies made so as to solve the above problems of the prior art, the present inventors have found that the desired object is achievable by the provision of a method for manufacturing nonwoven fabrics in which a fiber bundle comprising a plurality of composite fibers spun out of a spinneret is drawn by a drawing force of a high-speed air stream and blown against a working net conveyor while said air stream is sucked and removed from below the net conveyor to deposit said fiber bundle on the net conveyor to form a web, and the web is then heat-treated to develop crimps, and the fibers thermally adhere together at their points of contact, said method being characterized in that an air stream at room temperature is blown against said web from below said net conveyor for a time before the heat-treatment, with an intensity sufficient to float said web of which bottom face (as explained later) rises above said net conveyor by 0.2 to 30 mm.

BRIEF DESCRIPTION OF THE DRAWINGS

The present invention will now be explained specifically but not exclusively with reference to the accompanying drawings, in which:

FIG. I is a schematic view illustrative of one embodiment of the nonwoven fabric making system used in the present invention, and FIGS. II-a, b and c each provide a perspective illustration of the air stream blower used with the above system.

DETAILED EXPLANATION OF THE INVENTION

With two extruders (not shown), two sorts of thermoplastic resins are supplied to a composite spinneret 1, out of which a fiber bundle 2 comprising a plurality of heat-bondable composite fibers is spun. The fiber bundle 2 is then drawn by a high-speed air stream sucker 3 and blown against and deposited on a working net conveyor 4 to form a web 5. At a position of the net conveyor 4 against which the fiber bundle 2 is blown, a substantial portion of the high-speed air stream is sucked and removed by an exhaust unit 8 located back side thereof, whereby the web 5 is brought into close contact with the net conveyor 4 to stabilize its shape. The thus shape-stabilized web 5 moves with the net conveyor 4. Subsequently, the web 5 is made to float above the net conveyor 4 according to the characteristic feature of the present invention. More specifically, with an air stream blower 9 located before the position at which the web 5 reaches a heating furnace 6, an air stream at room temperature is blown against the web 5 from below the net conveyor 4 to make the web 5 to float in such a manner that the bottom face of the web 5 rises above the net conveyor 4 by 0.2 to 30 mm. (It is here to be noted that in a strict sense, there is no continuous bottom face, but, in the present disclosure, the assumed plane contacting the bottom of the web 5 is referred to as the bottom face of the web). At a floating height less than 0.2 mm, it is impossible to completely set free fibers entangled at a lower portion of the web 5 in the net, so that the shrinkage of the web becomes incomplete at the next heat treatment step, thus giving a nonwoven fabric which is of inferior bulkiness or has unevenness of unit-weight due to unevenness of the shrinkage or a network pattern of the net conveyor 4. At a floating height exceeding 30 mm, on the other hand, the entanglement of fibers in the web 5 becomes so loose that the web 5 is unstable in shape, thus making it impossible to obtain any uniform nonwoven fabric. Thus the web 5 is floated for a time above the net conveyor 4 in this manner, then the fibers are prevented from being entangled in the net. After passing above the air stream blower 9, the web 5 is relocated on the net conveyor 4, while the fibers are not entangled in the net. In this state, the web 5 is delivered with the net conveyor 4 into a heating furnace 6, wherein it is heat-treated to permit free development of crimps without being adversely affected, while the fibers are fixed together by the heat-adhesion of a low-melting component at their points of contact, thus giving a nonwoven fabric (7) of sufficient bulkiness.

The air stream blower 9 used may be of any type that the desired amount of an air stream is blown against the web uniformly across its widthwise direction. For instance, use may be made of a blower having a nozzle including a number of holes, as shown in FIG. II-a, a blower having a slitted nozzle, as shown in FIG. II-b and a blower having a multiplicity of nozzles located in the lengthwise direction of the web, as shown in FIG. II-c.

As the high-speed air stream sucker 3, use may be made of any one of known devices generally used for spun bonding.

As the heating furnace 6, an infrared type heater or a device using hot air as the heat source is preferable, since they do not mechanically hinder the development of crimps in fibers by heat treatments. On the other hand, a hot calender roll is not desired because of causing damage to the bulkiness of nonwoven fabrics. FIG. 1 is a schematic view of the heating furnace 6 having two stages of far-infrared type heaters.

The heat-bondable composite fibers used to obtain bulky nonwoven fabrics in the present invention are obtained by composite-spinning two or more sorts of thermoplastic resins having a difference of 10° C. or more, preferably 15° C. or more, between their melting points, the types of the composite fibers being in the form of a parallel, sheath-core or islands-in-sea form in which a low-melting resin occupies greater part than a half of the fibers' surfaces. Such composite fibers can successfully develop crimps through the heat-treatment of conditions suitably selected in the above heating furnace, and can be bonded and fixed together at their points of contact by the melt of the low-melting resin alone, thus giving a bulky and strong nonwoven fabric. Examples of combinations of such thermoplastic resins are crystalline polypropylene/high density polyethylene, crystalline polypropylene/ethylene-vinyl acetate copolymers, polyethyleneterephthalate/high density polyethylene, nylon 66/nylon 6, and others. The fineness of a single filament of the composite fibers and the number of crimps developed by heat treatments are suitably selected from a range 0.1 to 15 deniers and a range of 4 to 60 crimps/25 mm, respectively, depending upon the purposes of nonwoven fabrics. The density of nonwoven fabrics may suitably be selected from a wide range depending upon the purposes, e.g., a range of 0.005 to 0.02 g/cm$^3$ for the purpose of clothing waddings, a range of 0.01 to 0.05 g/cm$^3$ for the purpose of sanitary material surfacings and a range of 0.04 g/cm$^3$ or more for the purpose of clothing interlinings.

EXAMPLES

The present invention will more be specifically explained with reference to the following examples. It is understood that physical values mentioned below were measured in the following manners.

Density: Five square samples of 20 cm×20 cm were measured in terms of unit-weight in g/m$^2$ and thickness in cm. Density was then calculated from the following equation:

$$\text{Density in g/cm}^3 = \text{Unit-weight/Thickness} \times 10{,}000$$

Five calculated values were averaged.

Strength and Elongation:

Five test pieces, each of 5 cm×20 cm, were obtained from a sample in its warp and weft directions according to the measuring method JIS L 1085 (testing procedures for nonwoven fabric interlinings) —"Tensile Strength and Elongation"—, and were then tested at a grip gap of 10 cm and a tensile speed of 30 cm/min. to determine their breaking strength in kg/5 cm and elongation in %, which were then averaged.

EXAMPLE 1

A bulky nonwoven fabric was manufactured with a system similar to that shown in FIG. 1. Crystalline polypropylene (with a melt flow rate (MFR for short) of 22 as measured under the conditions specified in JIS K 7210, Condition 14 in Table 1) and high density polyethylene (with an MFR of 20 as measured under the conditions specified in JIS K 7210, Condition 4 in Table 1) were respectively supplied from extruders (A) and (B), both not shown, to a side-by-side type of composite spinneret 1 having 198 holes in a constant amount of 40 g/min. to spin composite fibers comprising the above two components and having a fineness of 1.8 d/f (deniers per filament) into a fiber bundle 2. With a high-speed air stream sucker 3 operating at an air speed of 2,020 m/min., the fiber bundle 2 was blown onto a net conveyor 4 moving at 11.5 m/min. to form a web 5. With an exhaust unit 8 located below the position at which the fiber bundle 2 was blown against the net conveyor 4, the blowing air was sucked and removed to fix the web 5 on the net conveyor 4, while air was blown against the net conveyor 4 from below with an air stream blower 9 before the web reached a heating furnace 6, thereby floating the web 5 about 3 mm above. As the air stream blower 9, use was made of a unit comprising three pipes arranged side by side in the moving direction of the web 5, each having a nozzle including a number of holes, as shown in FIG. II-a. After passing above the air stream blower 9, the web 5 was again settled on the net conveyor. Then, the web 5 was passed through a heating furnace 6 provided with a far-infrared type heater and adjusted to 140° C. at the first stage and 150° C. at the second stage for a period of 70 seconds for heat treatments. Finally, the web 5 was cooled off to obtain an nonwoven fabric 7. In the composite fiber, spiral crimps of 24 crimps/25 mm were developed by such heat treatments. In the nonwoven fabric 7, the composite fibers were fixed together at their points of contact by the heat-adhesion of high density polyethylene. The thus obtained nonwoven fabric had a unit-weight of 23 g/m$^2$, a thickness of 1.53 mm, a density of 0.015 g/cm$^3$, a strength of 2,450 g/5 cm in the warp direction and 1,510 g/5 cm in the weft direction, and an elongation of 70% in the warp direction and 46% in the weft direction, and the nonwoven fabric was uniform and free from any wrinkle and network pattern on its both front and back sides. This nonwoven fabric was found to be best-suited for disposable diapers surfacings.

EXAMPLE 2

With a similar system as used in Example 1, polyethylene terephthalate (with an intrinsic viscosity of 0.65) and linear low-density polyethylene (with an MFR of 20 as measured under the conditions specified in JIS K 7210, Condition 4 in Table 1) were respectively supplied from extruders (A) and (B) in a constant quantity of 40 g/min. for composite spinning. The obtained web 5 was processed at a drawing air stream speed of 1,450 m/min., a net conveyor speed of 6.8 m/min. and a floating height of web of about 8 mm, and was then thermally treated through a heating furnace 6 adjusted to 142° C. at both the first and second stages for a period of 2 minutes to obtain a nonwoven fabric 7. In the composite fiber, spiral crimps of 20 crimps/25 mm were developed by such heat treatments.

The nonwoven fabric 7 had a unit-weight of 40 g/m$^2$, a thickness of 2.35 mm, a density of 0.017 g/cm$^3$, a strength of 5,860 g/5 cm in the warp direction and 3,260 g/5 cm in the weft direction, and an elongation of 47% in the warp direction and 44% in the weft direction, and was so free from any wrinkle and network pattern on its both front and back sides that it was uniform. This nonwoven fabric was found to be best-suited for middle layer material in disposable diapers or clothing interlinings.

EXAMPLE 3

With a similar system as used in Example 1, crystalline polypropylene (with an MFR of 21) and propylene copolymer (with an MFR of 11 and consisting of 92 wt. % of propylene, 3.5 wt. % of ethylene and 4.5 wt. % of butene-1) were supplied from extruders (A) and (B), respectively. The obtained web 5 was processed under the same conditions as applied in Example 1, provided that it was floated about 5-mm above a net conveyor 4, thereby obtaining a nonwoven fabric 7. Under such conditions, spiral crimps of 36 crimps/25 mm were developed in the composite fiber. The thus obtained nonwoven fabric 7 had a unit-weight of 26 g/m$^2$, a thickness of 2.0 mm, a density of 0.013 g/cm$^3$, a strength of 2,410 g/5 cm in the warp direction and 1,430 g/5 cm in the weft direction, and an elongation of 36% in the warp direction and 32% in the weft direction, and was so free from any wrinkle and network pattern on its both front and back sides that it was uniform. This nonwoven fabric was found to be best-suited for surfacings or middle layer material in disposable diapers.

COMPARATIVE EXAMPLE 1

A nonwoven fabric was obtained under the same conditions as applied in Example 1, provided however that no air was blown against a web 5 deposited on a net conveyor 4 to float the former above the latter. The obtained nonwoven fabric had a unit-weight of 21 g/m$^2$, a thickness of 0.81 mm, a density of 0.026 g/cm$^3$, a strength of 3,020 g/5 cm in the warp direction and 1,930 g/5 cm in the weft direction, and an elongation of 63% in the warp direction and 32% in the weft direction, and was slightly wrinkled on its front side and scattered with network spots on its back side. This nonwoven fabric could not be used as disposable diapers' surfacings because of having large strength but being inferior in bulkiness and uniformity.

Thus, according to the present invention, bulky, uniform and light nonwoven fabrics can be obtained while maintaining the economical efficiency of spun bonding techniques.

What is claimed is:

1. A method for manufacturing nonwoven fabrics in which a fiber bundle, comprising a plurality of composite fibers spun out of a spinneret, is blown against a working net conveyor by a drawing force of a first high-speed air stream while said first air stream is sucked and removed from below the net conveyor to deposit said fiber bundle on the net conveyor to form a web, and the web is then heat-treated to develop crimps and the fibers thermally adhere together at their points of contact, wherein:

a second, room temperature air steam is blown against said web from below said net conveyor for a time before the heat-treatment, with an intensity sufficient to make said web to float in such a manner that a bottom face of said web rises above said net conveyor by 0.2 to 30 mm thereby disentangling the web from the net conveyor, said web being heat-treated after exposure to said second, room temperature air stream wherein the floating of the web permits free development of crimps during the heat-treatment.

* * * * *